US010455895B2

(12) United States Patent
Lafortune

(10) Patent No.: US 10,455,895 B2
(45) Date of Patent: Oct. 29, 2019

(54) ARTICLE OF FOOTWEAR INCORPORATING A SOLE STRUCTURE WITH ELEMENTS HAVING DIFFERENT COMPRESSIBILITIES

(71) Applicant: NIKE, Inc., Beaverton, OR (US)

(72) Inventor: Mario A. Lafortune, Tigard, OR (US)

(73) Assignee: NIKE, Inc., Beaverton, OR (US)

( * ) Notice: Subject to any disclaimer, the term of this patent is extended or adjusted under 35 U.S.C. 154(b) by 357 days.

(21) Appl. No.: 15/412,641

(22) Filed: Jan. 23, 2017

(65) Prior Publication Data

US 2017/0127756 A1 May 11, 2017

Related U.S. Application Data

(63) Continuation of application No. 14/920,630, filed on Oct. 22, 2015, now Pat. No. 9,572,400, which is a continuation of application No. 12/174,257, filed on Jul. 16, 2008, now Pat. No. 9,192,211.

(60) Provisional application No. 60/969,078, filed on Aug. 30, 2007.

(51) Int. Cl.

| | |
|---|---|
| ***A43B 3/18*** | (2006.01) |
| ***A43B 13/18*** | (2006.01) |
| ***A43B 13/10*** | (2006.01) |
| ***A43B 13/12*** | (2006.01) |
| ***A43B 21/26*** | (2006.01) |
| ***A43B 13/20*** | (2006.01) |
| ***A43B 13/04*** | (2006.01) |
| ***A43B 13/14*** | (2006.01) |
| ***A43B 13/22*** | (2006.01) |

(52) U.S. Cl.

CPC ..... *A43B 13/186* (2013.01); *A43B 13/04* (2013.01); *A43B 13/10* (2013.01); *A43B 13/12* (2013.01); *A43B 13/122* (2013.01); *A43B 13/125* (2013.01); *A43B 13/141* (2013.01); *A43B 13/187* (2013.01); *A43B 13/188* (2013.01); *A43B 13/20* (2013.01); *A43B 13/223* (2013.01); *A43B 21/26* (2013.01)

(58) Field of Classification Search

CPC ..... A43B 13/12; A43B 13/141; A43B 13/125; A43B 13/127

USPC .... 36/3 R, 36 C, 38, 37, 3 B, 28, 92, 43–44, 36/30 R

See application file for complete search history.

(56) References Cited

U.S. PATENT DOCUMENTS 5,086,574 A * 2/1992 Bacchiocchi ..... A43B 21/26 36/28

7,950,167 B2 * 5/2011 Nakano ..... A43B 13/186 36/28

(Continued)

*Primary Examiner* — Timothy K Trieu

(74) *Attorney, Agent, or Firm* — Quinn IP Law

(57) ABSTRACT

A sole structure of an article of footwear includes a foam element and a non-foam element with different compressibilities. The foam element is positioned adjacent to the non-foam element. The non-foam element may define a plurality of apertures, with ends of at least a portion of the apertures being located adjacent to a lower area of the foam element. The non-foam element may also form a protrusion that may be located in a central area of the non-foam element and extends into the foam element. In addition, a portion of the non-foam element that forms a side of the sole structure may define an indentation.

20 Claims, 23 Drawing Sheets

(56) References Cited

U.S. PATENT DOCUMENTS

| | | | | |
|---|---|---|---|---|
| 2003/0101620 | A1* | 6/2003 | Reed | A43B 7/1425 36/30 A |
| 2006/0230643 | A1* | 10/2006 | Affleck | A43B 3/108 36/153 |

* cited by examiner

ARTICLE OF FOOTWEAR INCORPORATING A SOLE STRUCTURE WITH ELEMENTS HAVING DIFFERENT COMPRESSIBILITIES

CROSS-REFERENCE To RELATED APPLICATIONS

This non-provisional U.S. Patent Application claims the benefit of priority to and is a Continuation of prior U.S. patent application Ser. No. 14/920,630, which was filed in the U.S. Patent and Trademark Office on Oct. 22, 2015, such prior U.S. Patent Application being entirely incorporated herein by reference. U.S. patent application Ser. No. 14/920,630 claims the benefit of priority to and is a Continuation of prior U.S. patent application Ser. No. 12/174,257, which was filed in the U.S. Patent and Trademark Office on Jul. 16, 2008 and is now U.S. Pat. No. 9,192,211, issued Nov. 24, 2015, such prior U.S. Patent Application being entirely incorporated herein by reference. U.S. patent application Ser. No. 12/174,257 claims the benefit of priority under 35 U.S.C. § 119(e)(1) to provisional U.S. Patent Application Ser. No. 60/969,078, which was filed in the U.S. Patent and Trademark Office on Aug. 30, 2007, such provisional U.S. Patent Application being entirely incorporated herein by reference.

BACKGROUND

Articles of footwear generally include two primary elements, an upper and a sole structure. The upper is formed from a variety of material elements (e.g., textiles, foam, leather, and synthetic leather) that are stitched or adhesively bonded together to form a void on the interior of the footwear for comfortably and securely receiving a foot. An ankle opening through the material elements provides access to the void, thereby facilitating entry and removal of the foot from the void. In addition, a lace is utilized to modify the dimensions of the void and secure the foot within the void.

The sole structure is located adjacent to a lower portion of the upper and is generally positioned between the foot and the ground. In many articles of footwear, including athletic footwear, the sole structure conventionally incorporates an insole, a midsole, and an outsole. The insole is a thin compressible member located within the void and adjacent to a lower surface of the void to enhance footwear comfort. The midsole, which may be secured to a lower surface of the upper and extends downward from the upper, forms a middle layer of the sole structure. In addition to attenuating ground reaction forces (i.e., providing cushioning for the foot), the midsole may limit foot motions or impart stability, for example. The outsole, which may be secured to a lower surface of the midsole, forms the ground-contacting portion of the footwear and is usually fashioned from a durable and wear-resistant material that includes texturing to improve traction.

The conventional midsole is primarily formed from a foamed polymer material, such as polyurethane or ethylvinylacetate, that extends throughout the length and width of the footwear. In some articles of footwear, the midsole may include a variety of additional footwear elements that enhance the comfort or performance of the footwear, including plates, moderators, fluid-filled chambers, lasting elements, or motion control members. In some configurations, any of these additional footwear elements may be located between the midsole and either of the upper and outsole, embedded within the midsole, or encapsulated by the foamed polymer material of the midsole, for example. Although many conventional midsoles are primarily formed from a foamed polymer material, fluid-filled chambers or other non-foam structures may form a majority of some midsole configurations.

SUMMARY

In an embodiment, a sole structure for an article of footwear comprises a first midsole element formed from a first material having a first degree of compressibility, and a second midsole element formed from a second material having a second degree of compressibility less than the first degree of compressibility. The second midsole element has an upper surface and an opposite lower surface, the lower surface being positioned adjacent to an upper area of the first midsole element. The second material contacts the upper area of the first midsole element. The second midsole element defines a plurality of apertures that extend from the upper surface to the lower surface and completely through the second midsole element. A lower portion of each of the apertures is located adjacent to the upper area of the first midsole element. A protrusion extends downward from the lower surface of the second midsole element and extends into a depression in the upper area of the first midsole element. The protrusion is located at a portion of a heel region of the sole structure. At least one of the apertures extends through the protrusion.

In an embodiment, a sole structure for an article of footwear comprises a first midsole element formed from a first material having a first degree of compressibility, and a second midsole element formed from a second material having a second degree of compressibility less than the first degree of compressibility. The first midsole element has an upper surface and an opposite lower surface, the lower surface being positioned adjacent to an upper surface of the second midsole element. The first material contacts the upper surface of the second midsole element. The upper surface of the second midsole element defines a series of protrusions extending in a direction from a lateral side to a medial side of the sole structure. The lower surface of the first midsole element defines a series of depressions extending in the direction from the lateral side to the medial side of the sole structure. Each of the protrusions of the series of protrusions extends into a respective one of the depressions of the series of depressions establishing a wavy interface extending in the direction from the lateral side to the medial side of the sole structure. The series of protrusions and the series of depressions are located at a portion of a heel region of the sole structure.

In an example of an article of footwear, a sole structure of the footwear includes a first midsole element and a second midsole element. Whereas the first midsole element may be formed from a foamed polymer material, the second midsole element may be formed from a non-foamed polymer material. The second midsole element is positioned adjacent to the first midsole element, and the second midsole element defines a plurality of apertures, with ends of at least a portion of the apertures being located adjacent to a surface of the first midsole element. In some configurations, the second midsole element may also define a protrusion that extends into the first midsole element, or a portion of the second midsole element that forms a side surface of the sole structure may include an elongate indentation.

The advantages and features of novelty characterizing aspects of the invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary and the following Detailed Description will be better understood when read in conjunction with the accompanying drawings.

DETAILED DESCRIPTION

The following discussion and accompanying figures disclose an article of footwear incorporating a sole structure with elements having materials with different compressibilities. Concepts related to the sole structure are disclosed with reference to a footwear configuration that is suitable for running. The sole structure is not limited to footwear designed for running, however, and may be utilized with a wide range of athletic footwear styles, including baseball shoes, basketball shoes, tennis shoes, football shoes, cross-training shoes, walking shoes, and soccer shoes, for example. The sole structure may also be utilized with footwear styles that are generally considered to be non-athletic, including dress shoes, loafers, sandals, and boots, for example. The concepts disclosed herein apply, therefore, to a wide variety of footwear styles, in addition to the specific style discussed in the following material and depicted in the accompanying figures.

General Footwear Configuration

Figure 1:
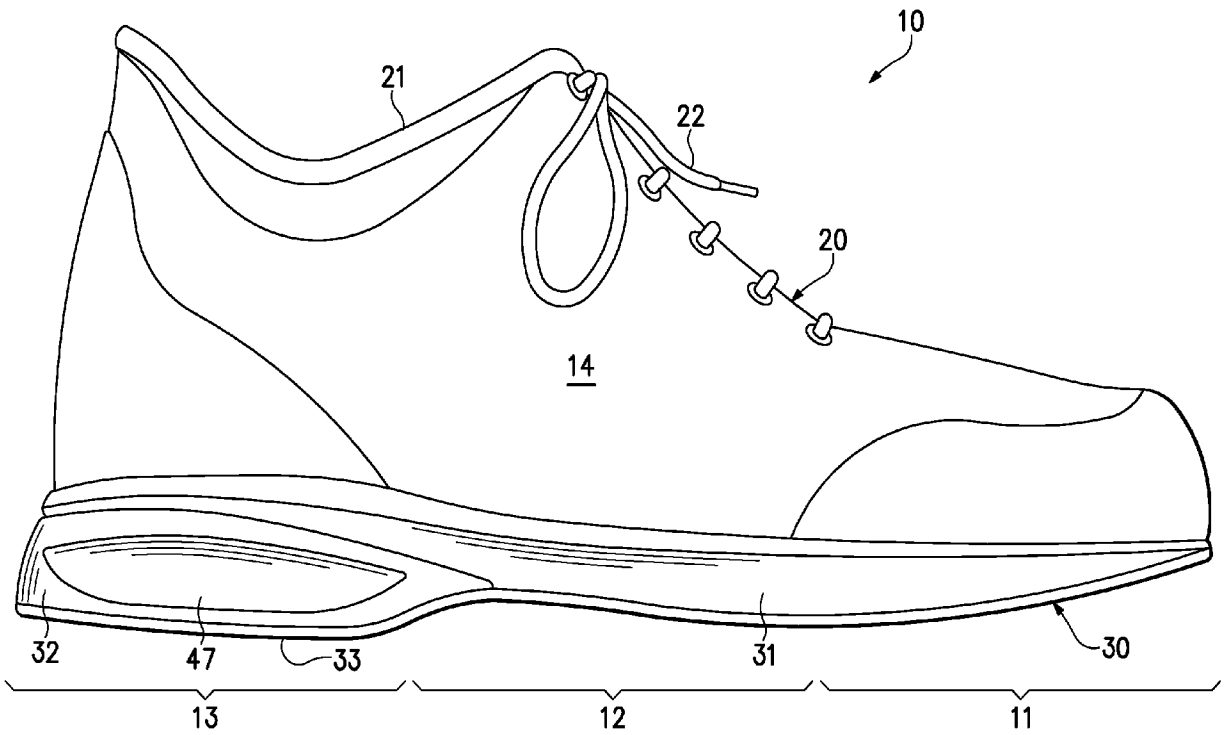
FIG. 1 is a lateral side elevational view of an article of footwear.
Figure 2:
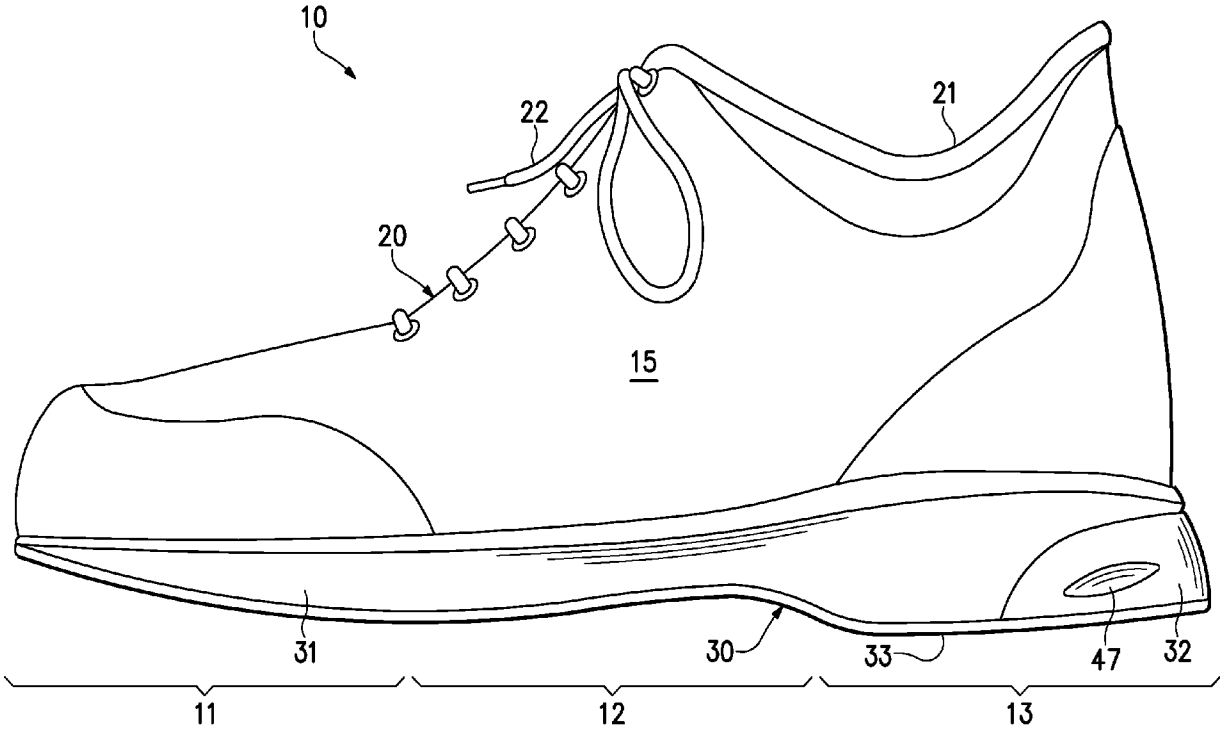
FIG. 2 is a medial side elevational view of the article of footwear.

An article of footwear 10 is depicted in FIGS. 1 and 2 as including an upper 20 and a sole structure 30. For reference purposes, footwear 10 may be divided into three general regions: a forefoot region 11, a midfoot region 12, and a heel region 13, as shown in FIGS. 1 and 2. Footwear 10 also includes a lateral side 14 and a medial side 15. Forefoot region 11 generally includes portions of footwear 10 corresponding with the toes and the joints connecting the metatarsals with the phalanges. Midfoot region 12 generally includes portions of footwear 10 corresponding with the arch area of the foot, and heel region 13 corresponds with rear portions of the foot, including the calcaneus bone. Lateral side 14 and medial side 15 extend through each of regions 11-13 and correspond with opposite sides of footwear 10. Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10, regions 11-13 and sides 14-15 may also be applied to upper 20, sole structure 30, and individual elements thereof.

Upper 20 is depicted as having a substantially conventional configuration incorporating a plurality material elements (e.g., textiles, foam, leather, and synthetic leather) that are stitched or adhesively bonded together to form an interior void for securely and comfortably receiving a foot. The material elements may be selected and located with respect to upper 20 in order to selectively impart properties of durability, air-permeability, wear-resistance, flexibility, and comfort, for example. An ankle opening 21 in heel region 13 provides access to the interior void. In addition, upper 20 may include a lace 22 that is utilized in a conventional manner to modify the dimensions of the interior void, thereby securing the foot within the interior void and facilitating entry and removal of the foot from the interior void. Lace 22 may extend through apertures in upper 20, and a tongue portion of upper 20 may extend between the interior void and lace 22. Given that various aspects of footwear 10 discussed in the following material primarily relate to sole structure 30, upper 20 may exhibit the general configuration discussed above or the general configuration of practically any other conventional or non-conventional upper. Accordingly, the structure of upper 20 may vary significantly.

Sole Structure Configuration

Figure 3:
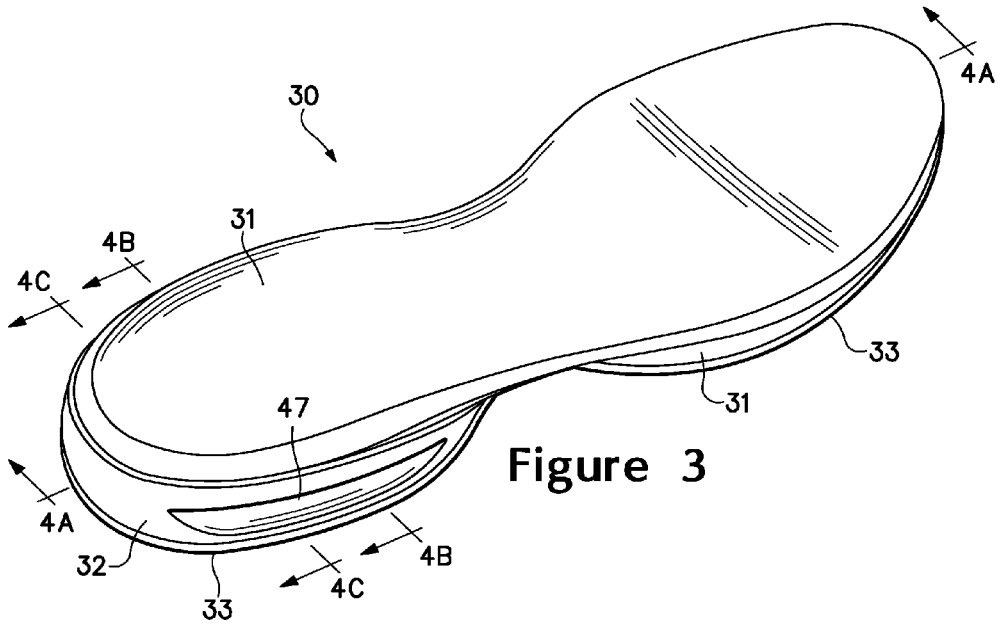
FIG. 3 is a perspective view of a sole structure of the article of footwear.
Figure 4A:
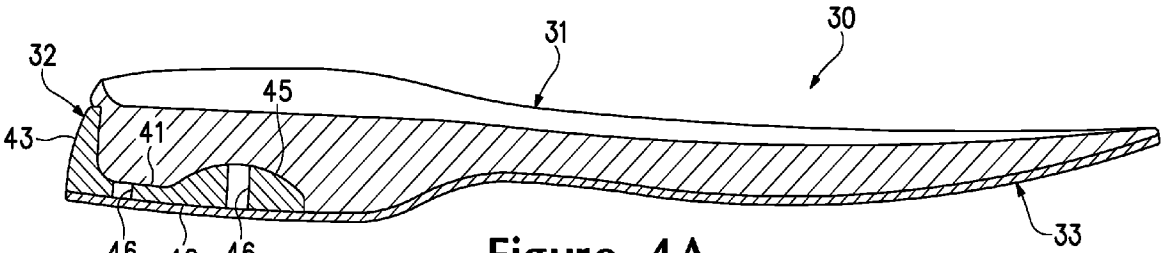
FIGS. 4A-4C are cross-sectional views of the sole structure, as defined by section lines 4A-4C in FIG. 3.
Figure 4B:
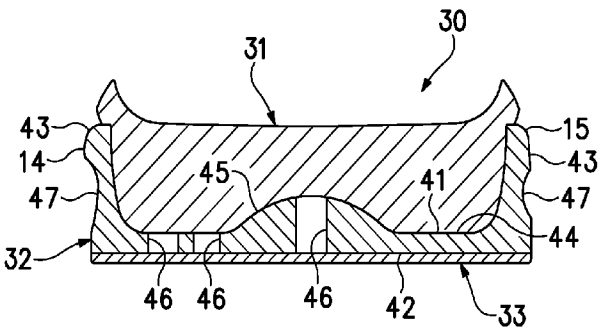
Figure 4C:
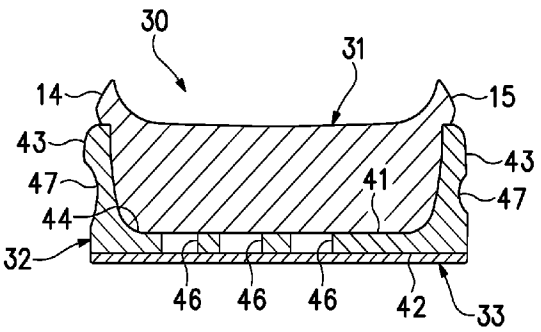
Figure 5:
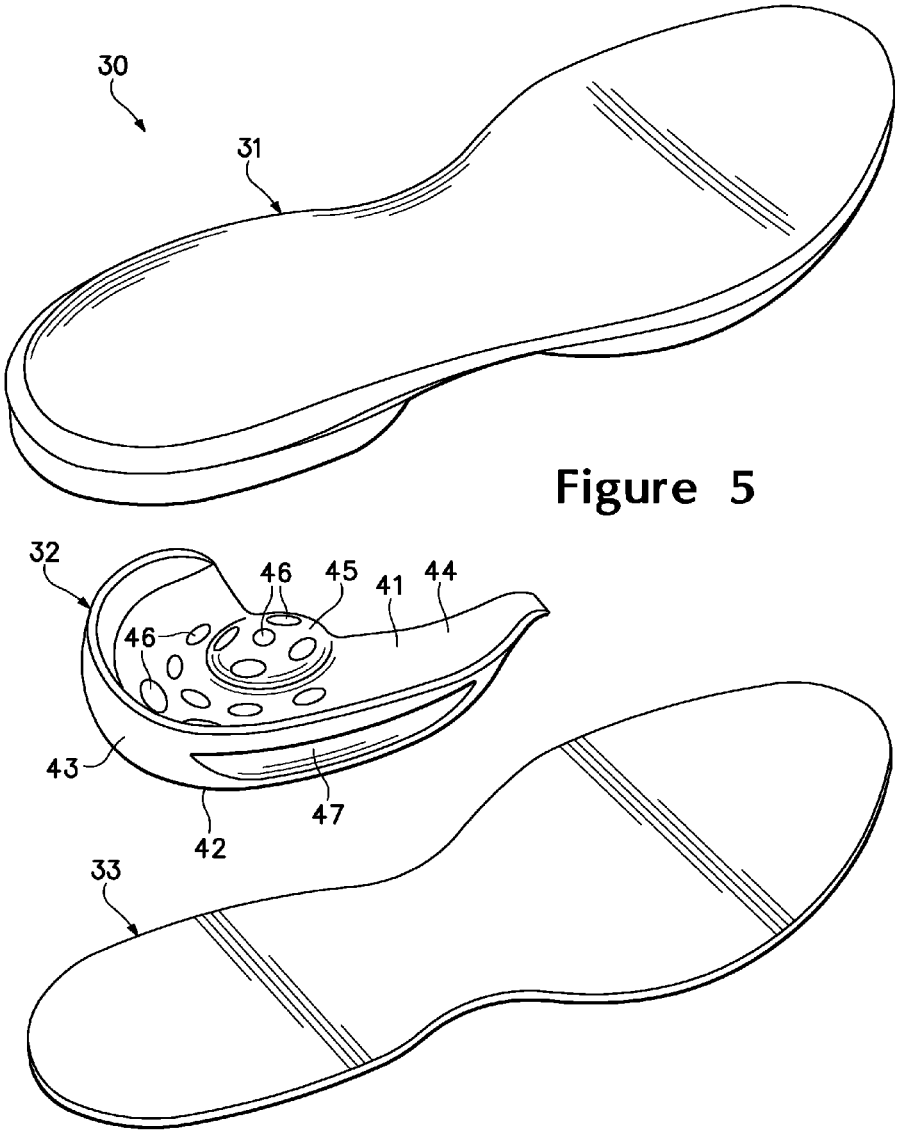
FIG. 5 is an exploded perspective view of the sole structure.

Sole structure 30 is secured to a lower area of upper 20 and extends downward from upper 20. When a foot is located within the void in upper 20, sole structure 30 is positioned to extend between the foot and the ground. In this position, sole structure 30 may, for example, limit foot motions, impart stability, or attenuate ground reaction forces (i.e., provide cushioning) when sole structure 30 is compressed by the foot. With reference to FIGS. 3-5, sole structure 30 is depicted as including a first midsole element 31, a second midsole element 32, and an outsole 33. First midsole element 31 is secured to the lower area of upper 20 and extends through each of regions 11-13 and between sides 14 and 15. In regions 11 and 12, first midsole element 31 extends between upper 20 and outsole 33. In heel region 13, however, second midsole element 32 extends between first midsole element 31 and outsole 33. More particularly, second midsole element 32 extends between a lower surface of first midsole element 31 and an upper surface of outsole 33 in portions of heel region 13. Outsole 33 may be formed from a rubber material that provides a durable and wear-resistant surface for engaging or otherwise contacting the ground. Outsole 33 may also be textured to enhance the traction (i.e., friction) properties between footwear 10 and the ground.

Figure 6:
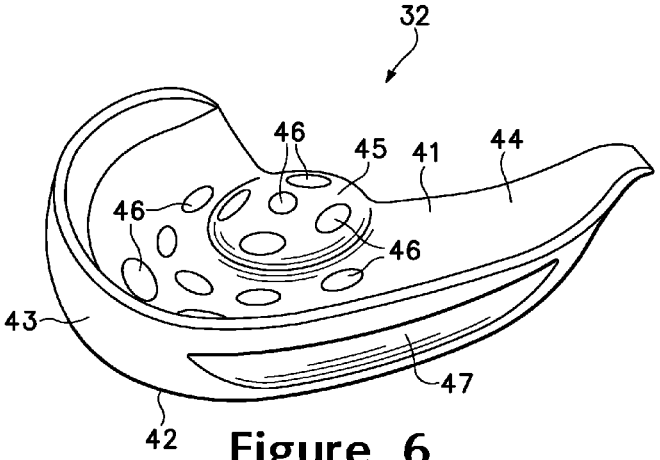
FIG. 6 is a perspective view of a midsole element of the sole structure. (Show upper surface)
Figure 7:
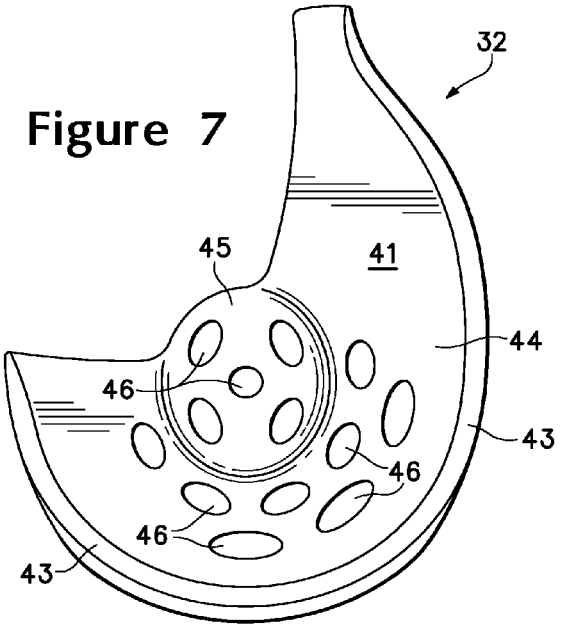
FIG. 7 is a top plan view of the midsole element.
Figure 8:
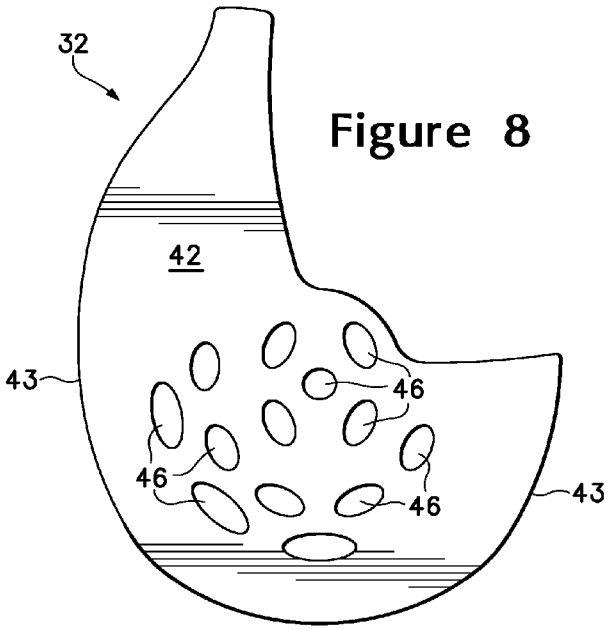
FIG. 8 is a bottom plan view of the midsole element.

Second midsole element 32 is depicted individually in FIGS. 6-8 and has an upper surface 41, an opposite lower surface 42, and a sidewall portion 43 that extends upward from a periphery of upper surface 41. Upper surface 41 contacts and is secured to the lower surface of first midsole element 31 through adhesive bonding or heat bonding, for example. Similarly, lower surface 42 contacts and is secured to an upper surface of outsole 33. As depicted in the cross-sections of FIGS. 4A-4C, lower surface 42 is substantially planar to form a generally flat interface with outsole 33, whereas upper surface 41 is contoured and interfaces with a correspondingly-contoured shape in the lower surface of first midsole element 31. In addition, sidewall portion 43 extends along sides of first midsole element 31 and is exposed to form a portion of a sidewall of sole structure 30 in heel region 13.

The contoured configuration of upper surface 41 includes a substantially planar peripheral area 44 and a protrusion 45 that extends upward from a central area of upper surface 41. As depicted in FIGS. 4A and 4B, protrusion 45 extends upward and into a depression formed in the lower area of first midsole element 31. Protrusion 45 is depicted as having a rounded aspect with a greater length than width. That is, protrusion 45 has an elliptical or otherwise eccentric shape. In further configurations, however, protrusion 45 may have flat surfaces or may be round, square, rectangular, pentagonal, or hexagonal in shape, for example. Although the relative proportions and positions of bones within different feet may vary significantly, (a) peripheral area 44 is located to generally correspond with a periphery of a heel region of a foot and (b) protrusion 45 is located to generally correspond with a position of a calcaneus bone of the foot. That is, second midsole element 32 is located within sole structure 30 such that the calcaneus bone of the foot received by the void within upper 20 is generally positioned above protrusion 45.

Second midsole element 32 defines a plurality of apertures 46 that extend in a substantially vertical direction and through second midsole element 32. That is, apertures 46 extend between upper surface 41 and lower surface 42, and upper ends of apertures 46 are located adjacent to the lower surface of first midsole element 31. Although portions of first midsole element 31 may extend into apertures 46 when sole structure 30 is compressed, as discussed in greater detail below, material may be absent from apertures 46. More particularly, a fluid (e.g., air) rather than a solid material may be located within apertures 46. As depicted in FIGS. 7 and 8, apertures 46 have elliptical shapes and are located through protrusion 45 and through a rear area of second midsole element 32 that is closer to lateral side 14 than medial side 15. As discussed in greater detail below, apertures 46 may have a non-vertical orientation, may be located in other portions of second midsole element 32, and may have a variety of different shapes.

Sidewall portion 43 extends upward from upper surface 41 and is exposed to form a portion of the sidewall of sole structure 30 in heel region 13. More particularly, opposite sections of sidewall portion 43 are located on lateral side 14 and medial side 15, and a central section of sidewall portion 43 extends around a rear area of sole structure 30. The sections of sidewall portion 43 located on lateral side 14 and medial side 15 each define an elongate indentation 47 that extends into second midsole element 32 from the exterior of sole structure 30. That is, indentations 47 extend into sidewall portion 43 and exhibit elongate shapes that extend along portions of lateral side 14 and medial side 15 in a generally horizontal direction.

One factor that determines the degree to which sole structure 30 limits foot motions, imparts stability, or attenuates ground reaction forces relates to the properties of the materials forming first midsole element 31 and second midsole element 32. Either of elements 31 and 32 may be formed from foamed polymer materials or non-foamed polymer materials. Examples of suitable foamed polymer materials include polyurethane and ethylvinylacetate foams that are conventionally utilized in footwear sole applications. Examples of suitable non-foamed polymer materials include a variety of thermoplastic and thermoset polymers, such as silicone, polyurethane, polyolefin, polyamide, polyurea, polyester, and styrene-olefin-rubber block copolymer. In some configurations, the non-foamed polymer material may be a gel material. Similarly, in some configurations, second midsole element 32 may be formed from a gel material. Another example of a suitable non-foamed polymer material for either of elements 31 and 32 is a cast polyurethane. In further configurations, first midsole element 31 may be formed to have the configuration of a compressible fluid-filled chamber.

In comparing the properties of the materials discussed above, the foamed polymer materials generally exhibit greater compressibility than the non-foamed polymer materials. When the foot presses downward upon sole structure 30, therefore, portions of sole structure 30 that are formed from a foamed polymer material will generally compress more than portions of sole structure 30 that are formed from a non-foamed polymer material. By selecting materials with different degrees of compressibility for elements 31 and 32, the manner in which sole structure 30 limits foot motions, imparts stability, or attenuates ground reaction forces (i.e., provide cushioning) may be affected. As an example of a combination of materials that may be utilized, first midsole element 31 may be formed from a foamed polymer material and second midsole element 32 may be formed from a non-foamed polymer material. In this configuration, when sole structure 30 is compressed between the foot and the ground, each of elements 31 and 32 may compress, but the foamed polymer material of first midsole element 31 will generally compress more than non-foamed polymer material of second midsole element 32. By incorporating structures such as protrusion 45, apertures 46, and indentation 47 into second midsole element 32, the compression characteristics of second midsole element 32 may be engineered to impart specific degrees of compressibility in different areas of sole structure 30. That is, structures such as protrusion 45, apertures 46, and indentation 47 in second midsole element 32 may be used to provide specific compression characteristics to sole structure 30.

The Running Cycle

Although the foamed polymer material of first midsole element 31 may compress more than the non-foamed polymer material of second midsole element 32, the structure of second midsole element 32 imparts specific compression characteristics to sole structure 30. The typical motion of the foot during running cycle proceeds as follows: First, the heel strikes the ground, followed by the ball of the foot. As the heel leaves the ground, the foot rolls forward so that the toes make contact, and finally the entire foot leaves the ground to begin another cycle. During the time that the foot is in contact with the ground and rolling forward, the foot also rolls from the outside or lateral side to the inside or medial side, a process called pronation. By incorporating features such as protrusion 45, apertures 46, and indentation 47 into second midsole element 32, ground reaction forces may be attenuated during the running cycle. In addition, second midsole element 32 may enhance the degree to which sole structure 30 imparts stability and limits the rolling motion of the foot to moderate pronation during the running cycle.

Figure 9A:
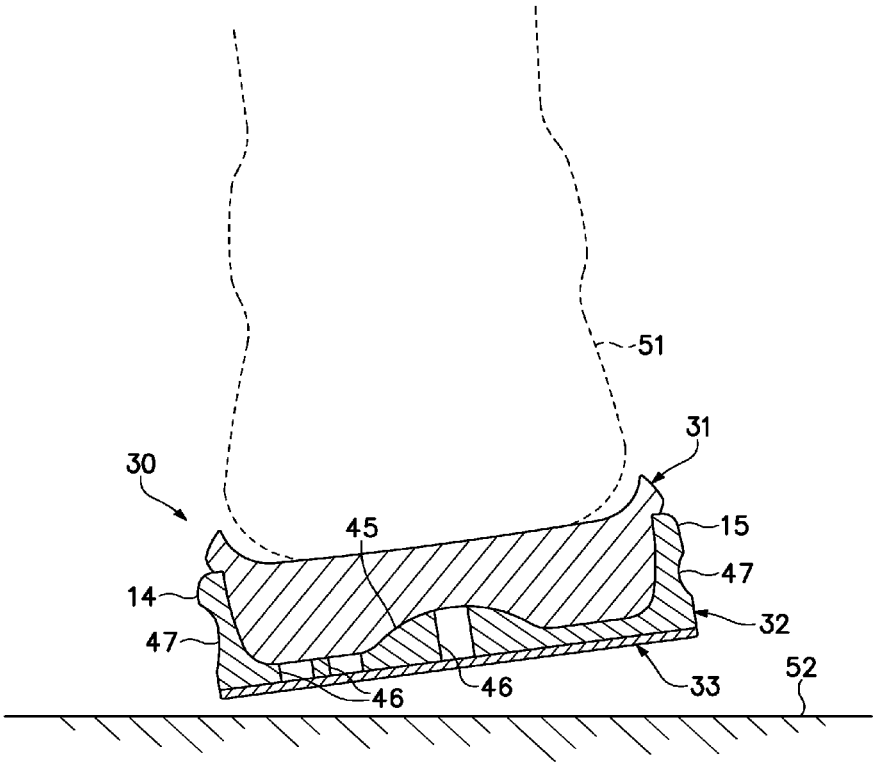
FIGS. 9A-9E are schematic cross-sectional views of the sole structure corresponding with FIG. 4B and depicting the sole structure in different states of compression.
Figure 9B:
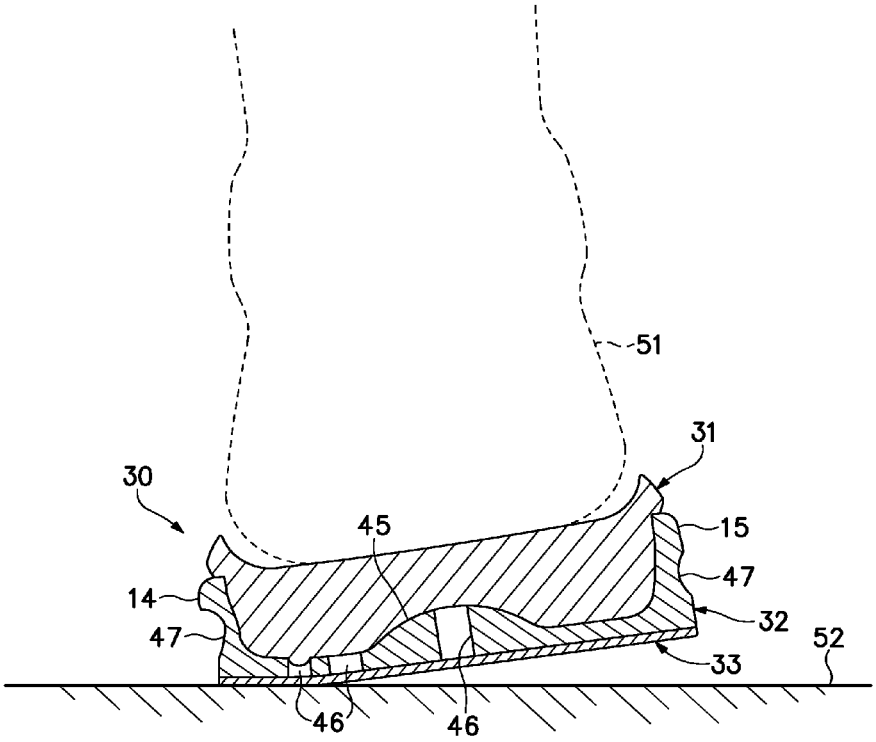

The manner in which sole structure 30 compresses and the manner in which features of second midsole element 32 affect the compression of sole structure 30 during the running cycle will now be discussed. Referring to FIG. 9A, sole structure 30 is shown as supporting a foot 51 and in a position where lateral side 14 is about to make contact with a ground surface 52. At this stage of the running cycle, foot 51 and sole structure 30 may be angled with respect to ground surface 52. When lateral side 14 of sole structure 30 makes contact with the ground, as depicted in FIG. 9B, portions of first midsole element 31 and second midsole element 32 adjacent to lateral side 14 experience compressive forces. More particularly, the generally compressible foamed polymer material of first midsole element 31 compresses and is reduced in thickness, whereas the less compressible non-foamed polymer material of second midsole element 32 compresses to a lesser degree. Due to the compressive forces upon second midsole element 32, however, indentation 47 begins to collapse. Whereas the non-foamed polymer material of second midsole element 32 may be less compressible than the foamed polymer material of first midsole element 31, indentation 47 provides a structure that effectively provides compression in second midsole element 32 by facilitating the collapsing of sidewall portion 43.

Figure 9C:
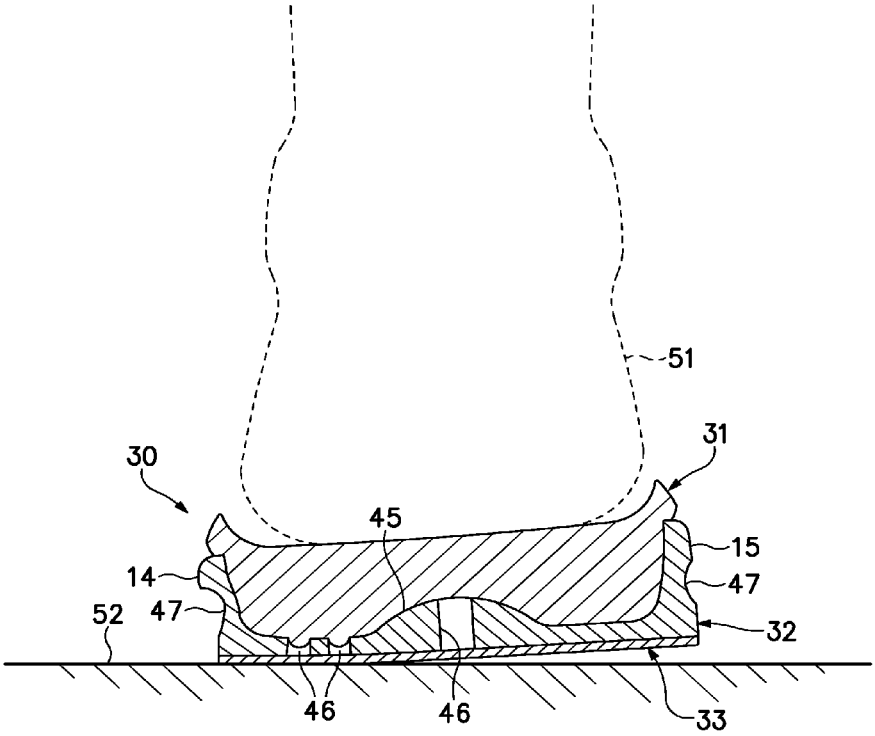

As the running cycle continues, foot 51 rolls forward and more toward medial side 15, as depicted in FIG. 9C. Whereas initial contact between sole structure 30 and ground surface 52 compressed portions of sole structure 30 immediately adjacent to lateral side 14, portions of sole structure 30 that are spaced inward from lateral side 14 are also compressed at this stage of the running cycle. More particularly, a greater portion of the compressible foamed polymer material of first midsole element 31 compresses and is reduced in thickness, and portions of peripheral area 44 located adjacent to lateral side 14 are also subjected to compressive forces. Due to the compressive forces upon second midsole element 32, apertures 46 of the non-foamed polymer material decrease in width to permit a reduction in the thickness of second midsole element 32. That is, apertures 46 provide spaces for second midsole element 32 to expand into, thereby facilitating an overall reduction in the thickness of second midsole element 32.

When the foamed polymer material of first midsole element 31 is subjected to a compressive force, cells or gas-filled pockets within the foamed polymer material decrease in volume to permit the foamed polymer material to compress. That is, the cells within the foamed polymer material decrease in size as first midsole element is compressed by foot 51. In contrast, the non-foamed polymer material of second midsole element 32 does not include a substantial amount of cells or gas-filled pockets. In order to compress, therefore, the non-foamed polymer material expands from the compressed area. Apertures 46 permit the non-foamed polymer material to expand. That is the non-foamed polymer material expands into apertures 46 as second midsole element 32 is compressed. Referring to FIG. 9C, therefore, apertures 46 decrease as second midsole element 32 is compressed to permit expansion of the non-foamed polymer material.

In addition to providing spaces for the expansion of the non-foamed polymer material, apertures 46 also provide a space for the foamed polymer material of first midsole element 31 to expand. Referring to FIG. 9C, first midsole element 31 is depicted as extending downward and into apertures 46. As a supplement to compressing, therefore, the foamed polymer material of first midsole element 31 may also expand into upper portions of apertures 46 in response to compressive forces generated as sole structure 30 is compressed between the foot and the ground. A similar phenomenon is shown in FIG. 9B for one of apertures 46.

Figure 9D:
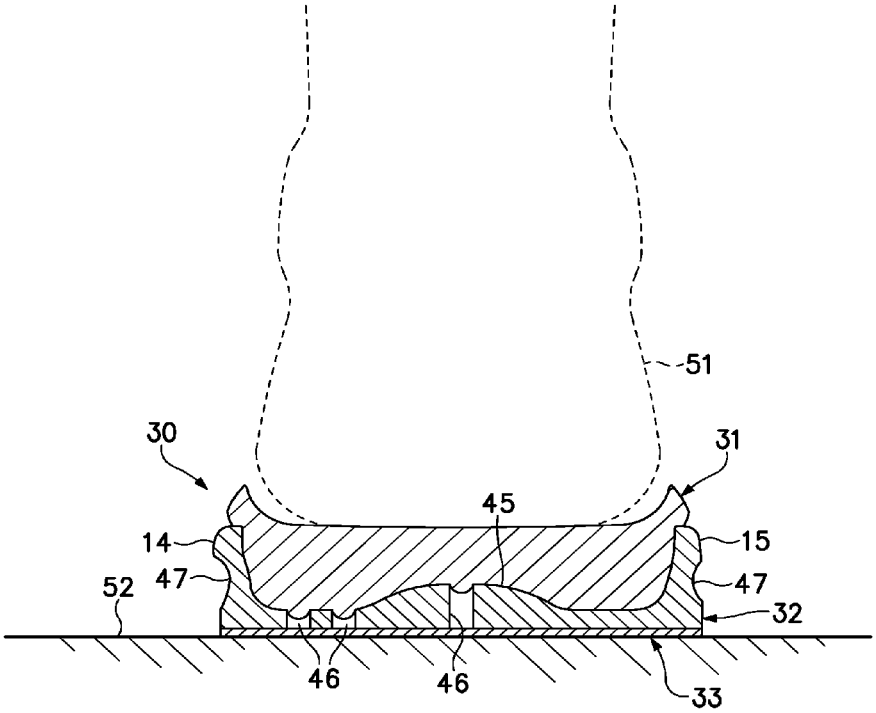

As the running cycle continues, foot 51 continues to roll forward and toward medial side 15 such that substantially all of a width of outsole 33 is in contact with ground surface 52, as depicted in FIG. 9D. Whereas previous contact between sole structure 30 and ground surface 52 compressed portions of sole structure 30 adjacent to lateral side 14, substantially all of the width of sole structure 30 in heel region 13 is compressed by foot 51 at this stage of the running cycle. In addition to compressing portions of sole structure 30 that are adjacent to sides 14 and 15, a calcaneus bone of foot 51 compresses central areas of sole structure 30. More particularly, a central portion of first midsole element 31 and protrusion 45 of second midsole element 32 are subjected to compressive forces. As with apertures 46 in peripheral area 44, apertures 46 in protrusion 45 decrease in width to permit expansion of the non-foamed polymer material, thereby permitting protrusion 45 to decrease in height or effectively compress.

Apertures 46 decrease in width to permit protrusion 45 to compress or otherwise decrease in thickness. The configuration of protrusion 45 also facilitates compression in second midsole element 32. Protrusion 45 extends upward above the surface of peripheral area 44 and is surrounded by the foamed polymer material of first midsole element 31. When a compressive force is applied to protrusion 45, the non-foamed polymer material forming protrusion 45 may expand outward to effectively increase the width of protrusion 45. That is, the non-foamed polymer material forming protrusion 45 may expand outward and into the foamed polymer material of first midsole element 31. Accordingly, various factors contributing to the compressibility of protrusion 45 include the shape of protrusion 45, the location of protrusion 45 within the foamed polymer material of first midsole element 31, and the presence of apertures 46 through protrusion 45.

As discussed above, protrusion 45 is located to generally correspond with a position of the calcaneus bone of foot 51. That is, the calcaneus bone is generally positioned above protrusion 45. During the portion of the running cycle depicted in FIG. 9D, therefore, the area of second midsole element 32 corresponding with protrusion 45 is effectively compressed by the calcaneus bone. In order to impart additional support for the calcaneus bone, protrusion 45 forms an area of second midsole element 32 with greater thickness than the areas immediately surrounding protrusion 45. In order to accommodate the greater thickness of second midsole element 32 in the area of protrusion 45, first midsole element 31 exhibits reduced thickness. Accordingly, by varying the thicknesses of first midsole element 31 and second midsole element 32, the relative properties of different areas of sole structure 30 may be modified. More particularly, differences in the relative thicknesses of elements 31 and 32 may be utilized to affect the degree to which sole structure 30 attenuates ground reaction forces, for example, in different areas of footwear 10.

Figure 9E:
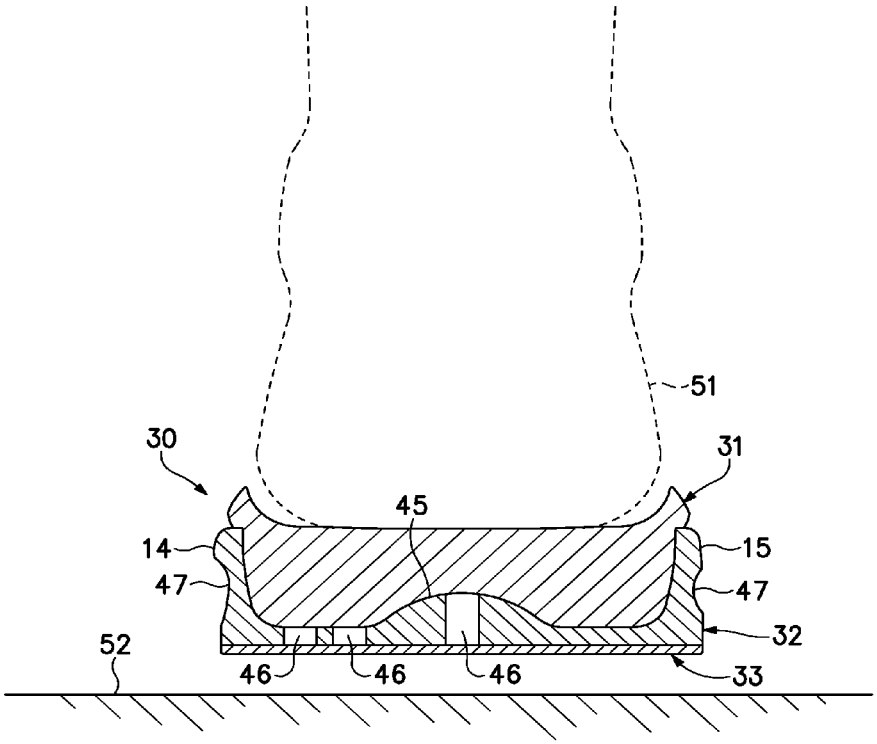

As the running cycle continues further, sole structure 30 separates from the ground, as depicted in FIG. 9E, and substantially returns to a non-compressed configuration. As the individual wearing footwear 10 continues running, the running cycle may repeat many times such that sole structure 30 is compressed between foot 51 and ground surface 52. In addition, structures such as protrusion 45, apertures 46, and indentation 47 may effectively facilitate compression in the non-foamed polymer material of second midsole element 32. That is, second midsole element 32, which is formed from a material with lesser compressibility than first midsole element 31, may effectively compress in the manner discussed above due to structures such as protrusion 45, apertures 46, and indentation 47.

Additional Sole Structure Configurations

Based upon the above discussion, the various structural features of second midsole element 32 (i.e., protrusion 45, apertures 46, and indentation 47) contribute to the compressibility of sole structure 30. More particularly, the various structural features affect the compressibility of sole structure 30 throughout the running cycle. Whereas foamed polymer materials generally exhibit substantially uniform compression properties, second midsole element 32 is specifically structured to impart different degrees of compressibility in different locations. Accordingly, the degree of ground reaction force attenuation imparted by different areas of sole structure 30 may be modified by changing the properties (e.g., shape, location, thickness) of protrusion 45, apertures 46, and indentation 47, for example.

The above discussion of sole structure 30 provides an example of one suitable configuration for first midsole element 31 and second midsole element 32. Various features of sole structure 30 may be varied, however, to impart different degrees of motion control, stability, or ground reaction force attenuation for the foot. Depending upon the specific activity for which footwear 10 is intended to be used, the configuration of first midsole element 31 and second midsole element 32 may vary significantly. More particularly, the configuration of first midsole element 31 and second midsole element 32 may vary to provide enhanced performance for sports that include basketball, tennis, football, walking, and soccer, for example. The configuration of first midsole element 31 and second midsole element 32 may also vary to provide different degrees of motion control, stability, or ground reaction force attenuation when footwear 10 is intended for non-athletic activities. Accordingly, the specific configuration of sole structure 30 discussed above and depicted in the figures is intended to provide one example of the manner in which footwear 10 may be structured.

In the above discussion and figures of footwear 10, sole structure 30 includes first midsole element 31, second midsole element 32, and outsole 33. In further configurations of footwear 10, however, sole structure 30 may include a variety of additional footwear elements that enhance the comfort or performance of footwear 10, including plates, moderators, fluid-filled chambers, lasting elements, or motion control members, for example. Although first midsole element 31 is depicted as being secured directly to the lower area of upper 20, any of these additional footwear elements may be located between first midsole element 31 and upper 20. Additionally, any of these additional footwear elements may be (a) located between first midsole element 31 and outsole 33, (b) located between first midsole element 31 and second midsole element 32, (c) located between second midsole element 32 and outsole 33, (d) embedded within either of first midsole element 31 and second midsole element 32, or (e) encapsulated by the materials forming first midsole element 31 and second midsole element 32, for example. Sole structure 30 may also incorporate an insole or sockliner that is located within the void in upper 20 and adjacent a lower surface of the foot to enhance comfort.

Figure 10A:
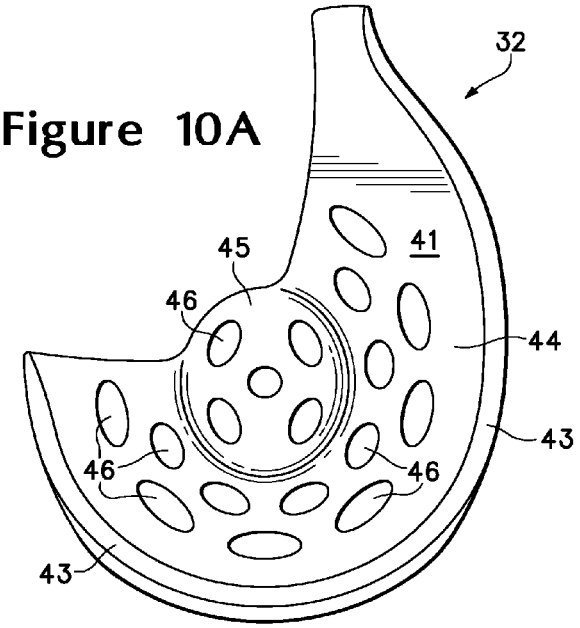
FIGS. 10A-10G are top plan views depicting additional configurations of the midsole element.
Figure 10B:
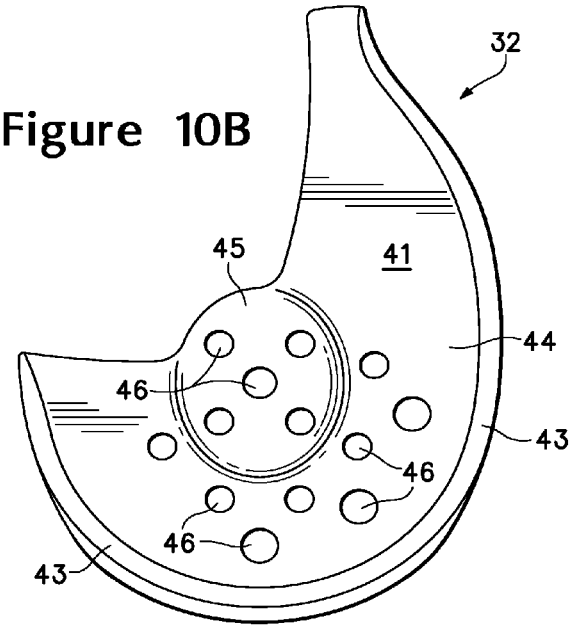
Figure 10C:
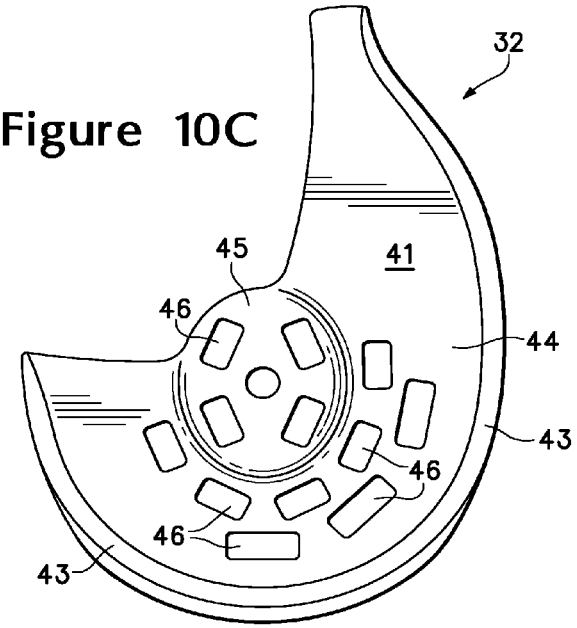
Figure 10D:
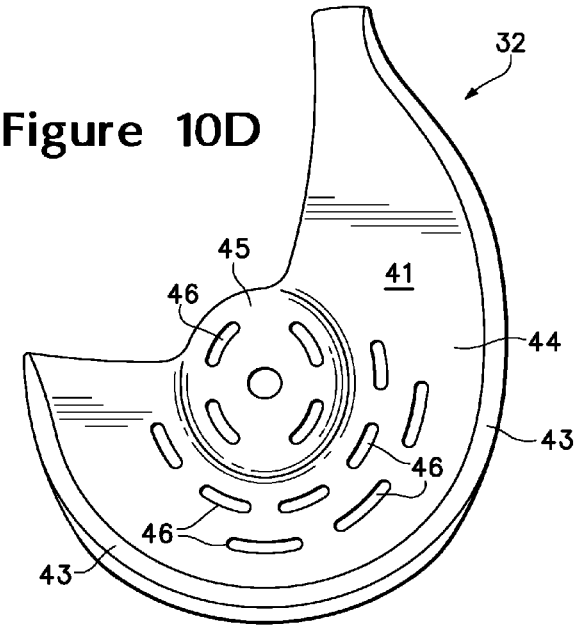
Figure 10E:
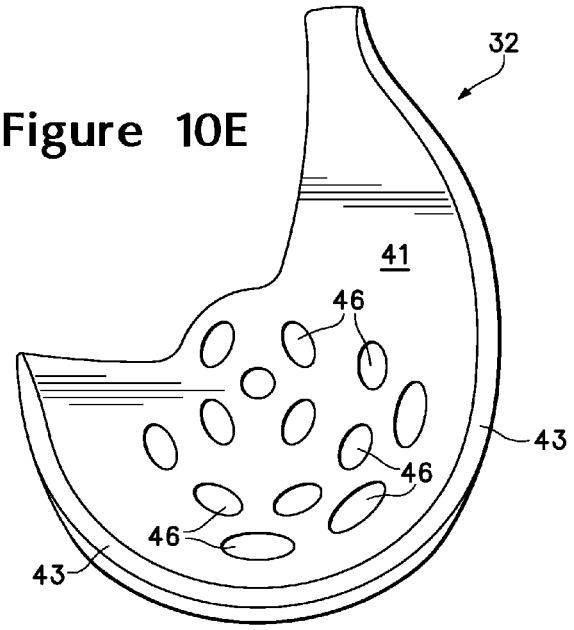
Figure 10F:
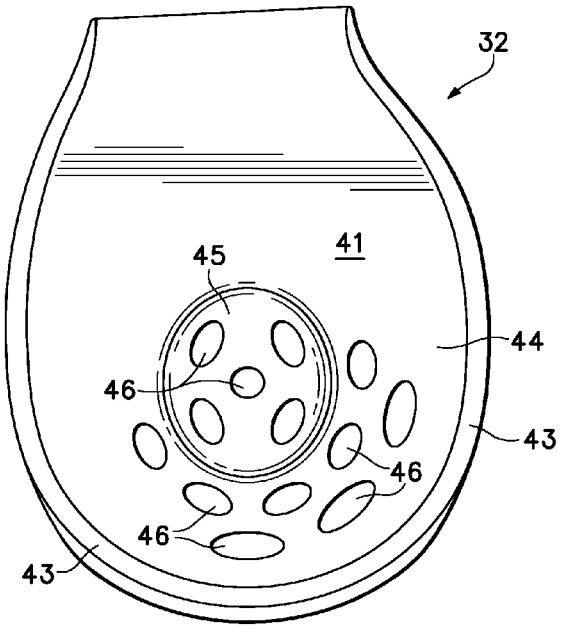
Figure 10G:
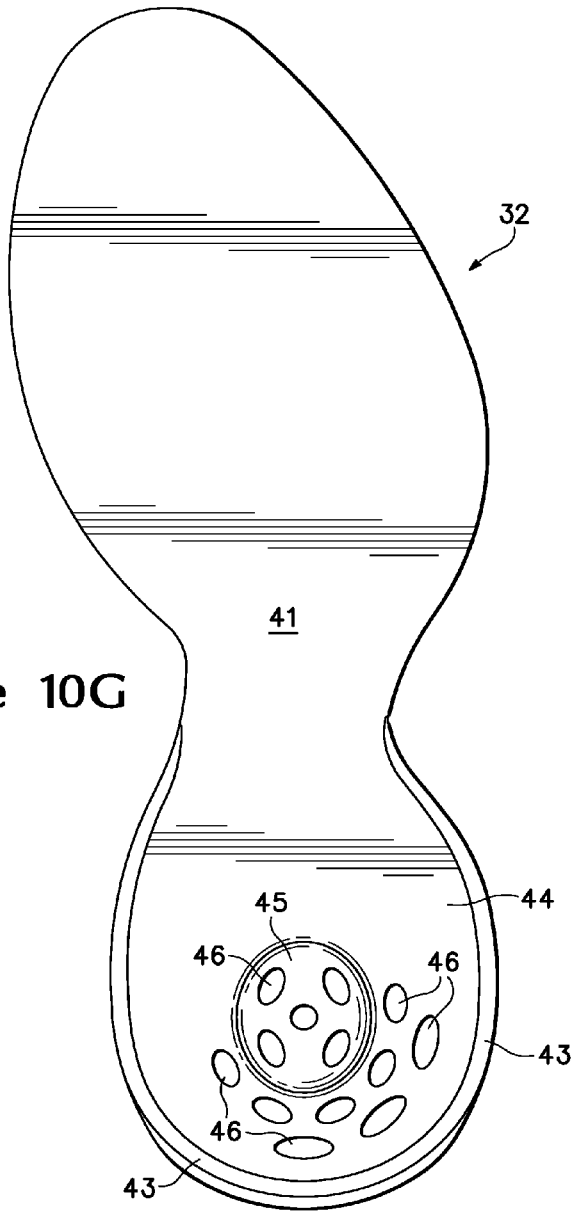

The configuration of second midsole element 32 may also be varied. Referring to FIG. 10A, second midsole element 32 is depicted as having a plurality of additional apertures 46 that extend throughout the width and length of second midsole element 32. Whereas apertures 46 in the configuration discussed above are primarily located through protrusion 45 and in a rear-lateral area of second midsole element 32, apertures 46 may extend through any region of second midsole element 32. The shape of apertures 46 may also vary to include round or rectangular shapes, as respectively depicted in FIGS. 10B and 10C. Apertures 46 may also have a more elongate and curved shape, as depicted in FIG. 10D. In further configurations, apertures 46 may have triangular, square, pentagonal, hexagonal, or non-regular shapes, or apertures 46 may have a variety of shapes. In another configuration, as depicted in FIG. 10E, protrusion 45 may be absent, but either of sidewall portion 43, apertures 46, or indentation 47 may also be absent. In the configuration depicted in FIGS. 6-8, lateral side 14 of second midsole element 32 extends forward to a greater extent than medial side 15. As depicted in FIG. 10F, however, both lateral side 14 and medial side 15 may extend forward to the same extent. While the configuration depicted in FIGS. 6-8 is limited to heel region 13, second midsole element 32 may also have a configuration that extends under substantially all of the foot, as depicted in FIG. 10G. Accordingly, the configuration of second midsole element 32 may vary significantly to impart different properties to footwear 10.

Figure 11A:
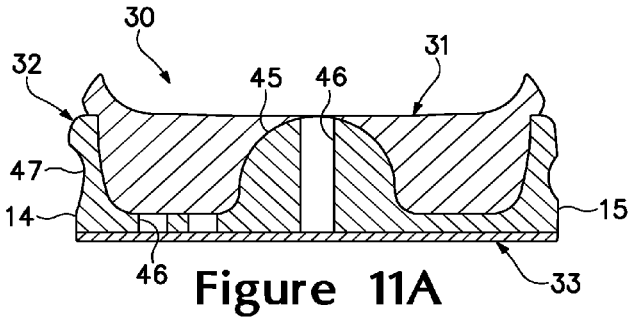
FIGS. 11A-11F are cross-sectional views of the sole structure corresponding with FIG. 4B and depicting additional configurations of the midsole element.
Figure 11B:
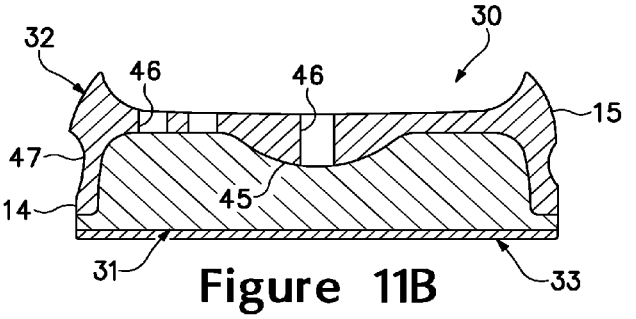
Figure 11C:
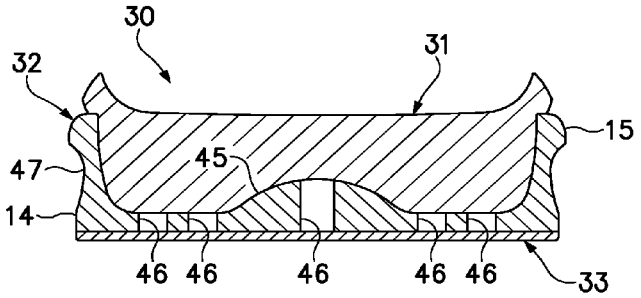
Figure 11D:
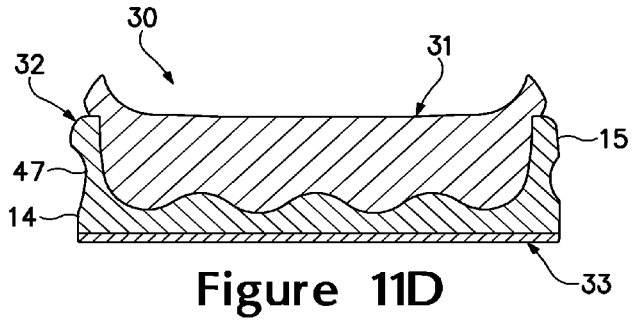
Figure 11E:
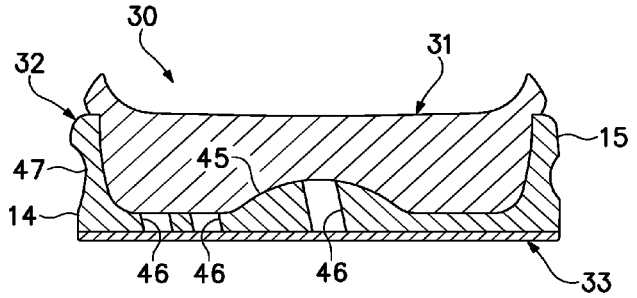
Figure 11F:
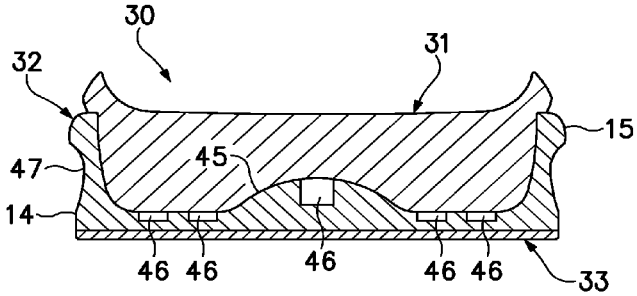

The combination of first midsole element 31 and second midsole element 32 extend between upper 20 and outsole 33. The manner in which first midsole element 31 and second midsole element 32 interface in this area may, however, vary significantly. Referring to FIG. 11A, protrusion 45 extends upward to be substantially flush with an upper surface of first midsole element 31. Although first midsole element 31 may be positioned above second midsole element 32, the second midsole element 32 may also be positioned above first midsole element 31 in some configurations of footwear 10, as depicted in FIG. 11B. Second midsole element 32 may also be formed to have a substantially symmetrical configuration that extends upward on both sides of first midsole element 31, as depicted in FIG. 11C. Second midsole element 32 may also have a configuration that defines a wavy interface between elements 31 and 32, as depicted in FIG. 11D. Additionally, apertures 46 may be oriented to extend in a non-vertical direction, as depicted in FIG. 11E, or apertures 46 may be formed to extend only partially through second midsole element 32, as depicted in FIG. 11F.

Figure 12:
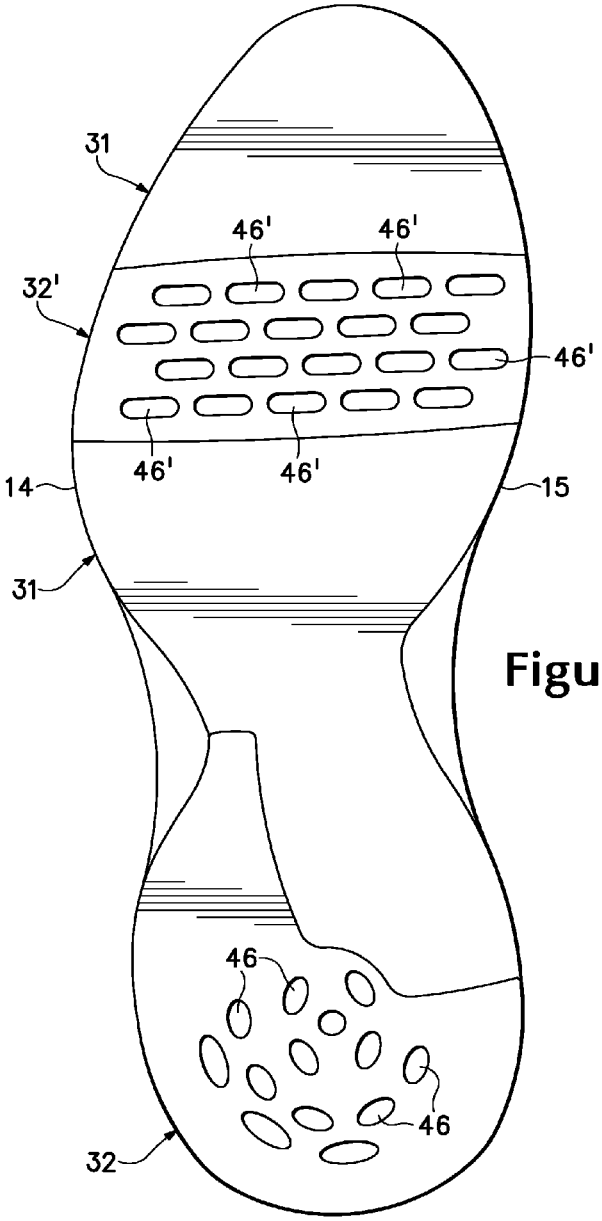
FIG. 12 is a bottom plan view depicting an additional configuration of the sole structure.

The configuration of second midsole element 32 depicted in FIGS. 6-8 is intended to be utilized in heel region 13 of footwear 10. Elements incorporating the concepts discussed above for second midsole element 32 may also be utilized in other areas of footwear 10. Referring to FIG. 12, sole structure 30 is depicted as including second midsole element 32 in heel region 13 and another second midsole element 32' at an interface of forefoot region 11 and midfoot region 12. Second midsole element 32' extends from lateral side 14 to medial side 15 and includes a plurality of elongate apertures 46' that are oriented to extend between sides 14 and 15. As with apertures 46, apertures 46' may facilitate expansion of a non-foamed polymer material and permit first midsole element 31 to expand downward. An additional advantage of apertures 46' relates to the flexibility of sole structure 30. More particularly, the elongate configuration of apertures 46' effectively form flexion lines that facilitate flex in sole structure 30. Accordingly, elements similar to second midsole element 32 may be utilized in other areas of footwear 10 to impart further benefits to sole structure 30.

The invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

The invention claimed is:

1. A sole structure for an article of footwear comprising:

a first midsole element formed from a first material having a first degree of compressibility; wherein the first midsole element has an upper area with a depression;

a second midsole element formed from a second material having a second degree of compressibility less than the first degree of compressibility, the second midsole element having an upper surface and an opposite lower surface, the lower surface being positioned adjacent to the upper area of the first midsole element, the second material contacting the upper area of the first midsole element, the second midsole element defining a plurality of apertures that extend from the upper surface to the lower surface and completely through the second midsole element, a lower portion of each of the apertures being located adjacent to the upper area of the first midsole element; and wherein the sole structure has a heel region; wherein the second midsole element includes a protrusion that extends downward from the lower surface of the second midsole element and into the depression in the upper area of the first midsole element, the protrusion being located at a central portion of the heel region of the sole structure, and wherein at least one of the apertures extends through the protrusion.

2. The sole structure of claim 1, wherein the first midsole element has a lower surface; and the sole structure further comprising:

an outsole secured to the lower surface of the first midsole element.

3. The sole structure of claim 1, wherein the first midsole element has a lower surface; and wherein the lower surface of the first midsole element is substantially flat.

4. The sole structure of claim 1, wherein the second material contacts and is secured to the upper surface of the first midsole element.

5. The sole structure of claim 1, wherein the at least one of the apertures that extends through the protrusion has an elongate configuration.

6. The sole structure of claim 1, wherein each of the apertures is oriented to extend in a substantially vertical direction when the sole structure rests on a ground plane.

7. The sole structure of claim 1, wherein the protrusion is located in a central area of the second midsole element.

8. The sole structure of claim 1, wherein a sidewall portion of the second midsole element extends downward from the lower surface of the second midsole element, the sidewall portion being located laterally adjacent to a side surface of the first midsole element and extending along the side surface.

9. The sole structure of claim 8, wherein the sidewall portion forms a portion of an exterior surface of the sole structure.

10. The sole structure of claim 9, wherein the sidewall portion defines an elongate indentation extending into the second midsole element, the elongate indentation being located on a lateral side of the exterior surface of the sole structure.

11. The sole structure of claim 1, wherein the first midsole element is a foam element, and the second midsole element is a non-foam element.

12. A sole structure for an article of footwear comprising:

a first midsole element formed from a first material having a first degree of compressibility;

a second midsole element formed from a second material having a second degree of compressibility less than the first degree of compressibility, the first midsole element having an upper surface and an opposite lower surface, the lower surface being positioned adjacent to an upper surface of the second midsole element, the first material contacting the upper surface of the second midsole element; and wherein the upper surface of the second midsole element defines a series of protrusions extending in a direction from a lateral side to a medial side of the sole structure;

wherein the lower surface of the first midsole element defines a series of depressions extending in the direction from the lateral side to the medial side of the sole structure; wherein each of the protrusions of the series of protrusions extends into a respective one of the depressions of the series of depressions establishing a wavy interface extending in the direction from the lateral side to the medial side of the sole structure, the series of protrusions and the series of depressions being located at a portion of a heel region of the sole structure;

wherein the second midsole element defines a plurality of apertures that extend from the upper surface of the second midsole element to the lower surface of the second midsole element and completely through the second midsole element, and wherein at least one of the apertures extends through one of the protrusions;

wherein a sidewall portion of the second midsole element extends upward from a lower surface of the second midsole element, the sidewall portion being located laterally adjacent to a side surface of the first midsole element and extending along the side surface; and wherein the sidewall portion forms a portion of an exterior surface of the sole structure.

13. The sole structure of claim 12, further comprising:

an outsole secured to the lower surface of the second midsole element, the lower surface of the second midsole element being opposite to the upper surface of the second midsole element.

14. The sole structure of claim 13, wherein the lower surface of the second midsole element is substantially flat.

15. The sole structure of claim 12, wherein the wavy interface is symmetrical from the medial side to the lateral side.

16. The sole structure of claim 12, wherein the series of protrusions includes only three protrusions, and the series of depressions includes only three depressions.

17. The sole structure of claim 12, wherein the sidewall portion defines an elongate indentation extending into the second midsole element, the elongate indentation being located on a lateral side of the exterior surface of the sole structure.

18. The sole structure of claim 12, wherein the first midsole element is a foam element, and the second midsole element is a non-foam element.

19. The sole structure of claim 12, wherein each protrusion of the series of protrusions is of the same height and the same shape.

20. The sole structure of claim 12, wherein the second midsole element, including the sidewall portion, is a unitary and one-piece component of the second material.

* * * * *